United States Patent [19]

Veith et al.

[11] Patent Number: 4,527,484

[45] Date of Patent: Jul. 9, 1985

[54] CONVEYOR APPARATUS, PARTICULARLY FOR SUSPENSION CONVEYANCE

[75] Inventors: Gustav G. Veith, Frasdorf; Rolf Schönenberger, Landsberg; Udo Thumser, Baldham; Georg Ziegler, Unterhaching, all of Fed. Rep. of Germany

[73] Assignee: Veit GmbH & Co., Landsberg, Fed. Rep. of Germany

[21] Appl. No.: 500,749

[22] Filed: Jun. 3, 1983

[30] Foreign Application Priority Data

Jun. 8, 1982 [DE] Fed. Rep. of Germany ..... 3221646

[51] Int. Cl.[3] ..... B61K 1/00

[52] U.S. Cl. ..... 104/89; 198/473; 414/337; 414/338

[58] Field of Search ..... 104/89, 96; 105/148; 198/473; 414/337, 389

[56] References Cited

U.S. PATENT DOCUMENTS 3,987,734 10/1976 Horn ..... 104/89

4,057,017 11/1977 Michalon ..... 104/89

FOREIGN PATENT DOCUMENTS 2347748 3/1976 Fed. Rep. of Germany ..... 104/89

*Primary Examiner*—Robert R. Song

*Attorney, Agent, or Firm*—James E. Nilles

[57] ABSTRACT

The invention relates to a conveyor apparatus, particularly for intra-plant and plant-to-plant suspension conveyance, comprising a conveyor rail system for the conveyance therealong of bridge-type carriers suspended at both ends from the conveyor rails by means of rollers connected to said carriers by brackets, and container means for the goods to be conveyed, said container means being suspended from said carrier by means of a carrier head releasably engaging said carrier from above.

In order to enable said container means to be suspended from said rail system for conveyance or to be released therefrom, respectively, with a minimum of structural and labor expenditure, the carrier head is adapted to be released from the carrier by being lifted relative thereto and withdrawn in the longitudinal direction thereof.

For use with container means in the form of containers equipped with ground-engaging wheels or rollers for conveyance over the ground independent of the rail system there are provided engagement and release locations, respectively, whereat a preferably relative movement between the carrier and the carrier head is positively brought about.

20 Claims, 3 Drawing Figures

CONVEYOR APPARATUS, PARTICULARLY FOR SUSPENSION CONVEYANCE

DESCRIPTION

Figure 1:
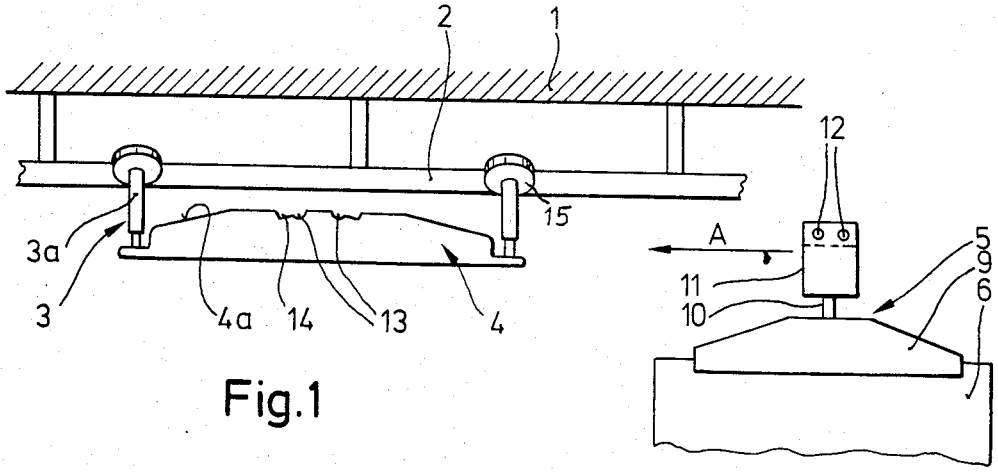

The present invention relates to a conveyor apparatus according to the generic clause of claim 1.

In a known conveyor apparatus of this type (DE-PS No. 23 47 748), the container means is designed for the conveyance of boxes and the like and is provided with a carrier head in the form of a rotatable bearing attached to a channel section member. The carrier and carrier head together form a pendulum suspension for the container means. To this effect, the carrier is formed with a pair of spaced recesses in its upper rim portion. The carrier head is provided with bolts extending between the legs of the channel section member at a spacing corresponding to that of the recesses so as to be received therein in the assembled state. Pendulum movement of the container means is permitted by the bolt towards the side of which said pendulum movement occurs being able to move upwards in the respective recess. The carrier head may also be bodily lifted with respect to the carrier, so that the bolts are disengaged from the recesses. Complete separation of the carrier head from the carrier requires the bolts to be withdrawn from the channel section member, however. Failing that, such separation in the lateral direction is prevented by the engagement of the bolts with the suspension brackets. For this reason the known conveyor apparatus is designed in such a manner that the brackets together with the carrier and anything that might be suspended therefrom are adapted to be bodily removed from the conveyor rail, if need be. To this effect, the conveyor rail system has certain locations thereof formed with a modified rail section permitting the carrier to be disengaged.

This known conveyor apparatus thus requires all of the container means to be provided with their own carrier and brackets attached thereto, said carrier remaining connected to the container means even if the latter is not in use. As a result, the purchase of the individual container means becomes rather expensive, and handling of the container means in the off-rail condition is cumbersome. The alternative solution, namely, the employ of a single carrier with its brackets for a plurality of interchangeable container means, would require the bolts to be withdrawn and reinserted at each change of the container means. This method suffers, however, from the disadvantages that mounting of the container means is time-consuming, that it may be neglected, with a view to saving time, to properly insert the bolts into the carrier heads in the non-use condition, whereby the bolts may be lost, and that it may be forgotten to secure the bolts against falling out of the channel section member after the carrier head has been connected to the carrier.

It is an object of the present invention to improve a conveyor apparatus of the type set forth in the introduction so as to permit the container means to be readily suspended from the conveyor rail system with a minimum of structural and labour expenditure.

This object is attained according to the invention by the characteristic of claim 1.

According to the invention, the design of the carrier head and carrier permits these two parts to be separated from one another and to be reconnected quickly and in a simple manner. Depending on the type, the size and the load condition of the container means, the respective operations may be carried out manually or with the aid of mechanical devices. A substantial advantage is offered by the fact that the carriers with their brackets and the container means may be stored, used and, most important, purchased independently of each other. In addition, the connection of the carrier head to the carrier as well as the separation of the two parts is easily accomplished irrespective of whether the carrier is suspended from the rail system by its brackets. This gives the user the greatest latitude in adapting the conveyor apparatus to any given requirements.

An advantageously simple configuration is provided by the characteristic feature of claim 2. According thereto, the cross-sectional shapes of the carrier and of the carrier head may be varied within a wide range.

The characteristic set forth in claim 3 facilitates the lateral disengagement of the carrier head from the carrier, as it permits the carrier head to be slightly lowered, or tilted, respectively, prior to being completely disengaged. A further advantage of this configuration consists in that the brackets are attached to the carrier interiorly of the cross-sectional shape thereof may diverge beyond the cross-section of the carrier at a smaller distance above their points of attachment. This is of particular interest in the case in which the brackets are of Y-shaped configuration with their arms straddling the conveyor rail from below. In this case, the branched portion of the Y-configuration may be located at a small distance above the attachment point of the brackets, whereby the overall height of the bracket-carrier combination is reduced in favour of that of the container means to be conveyed.

The characteristic of claim 4 and those of claims 5 to 7, which relate to various embodiments thereof, offer the advantage that the carrier head comes into positive engagement with the carrier at a position whereat its equilibrium is ensured. According to these characteristics, the connection between the engaging elements and the engagement locations may constitute a mounting arrangement offering free movability within a wide range (claim 7), with the possibility of pendulum movements, or may form a rigid retention arrangement for the carrier head, for instance in the form of bolts or the like to be inserted from above into bores of a substantially horizontal ledge. The characteristic of claim 5 permits the suspension to be adapted to inclination angles of the rails while maintaining a suitable distance between the container means and the rail.

The characteristic of claim 9 relates to an advantageous modification of the conveyor apparatus according to the invention, whereby the connection between the carrier and the carrier head as well as the separation of the two parts is further facilitated, in that the relative vertical movement between the carrier and the carrier head is positively brought about. Claims 10 and 11 show advantageous embodiments of such release locations. Particularly in the case of a ground-engageable wheeled container means, an operator may selectively advance the container means and its carrier head together with the carrier to a point beyond the release location, whereat reengagement of the two parts occurs in a substantially automatic manner, or may advance only one of the two parts so as to separate them one from the other. Engagement of the two parts is brought about conversely by locating the carrier as well as the container means with its carrier head at a release location, which in this case functions as an engagement location. The container means, if equipped with ground-engaging rollers or wheels, may also be used for intra-plant and plant-to-plant ground conveyance.

Figure 3:
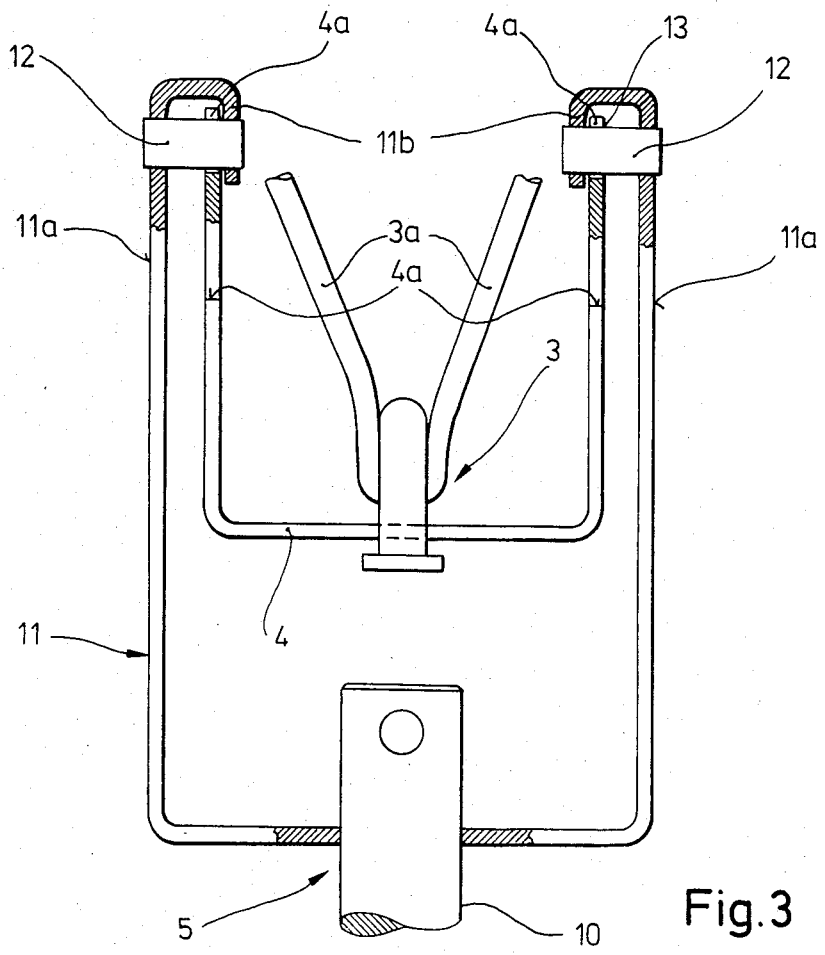
Figure 2:
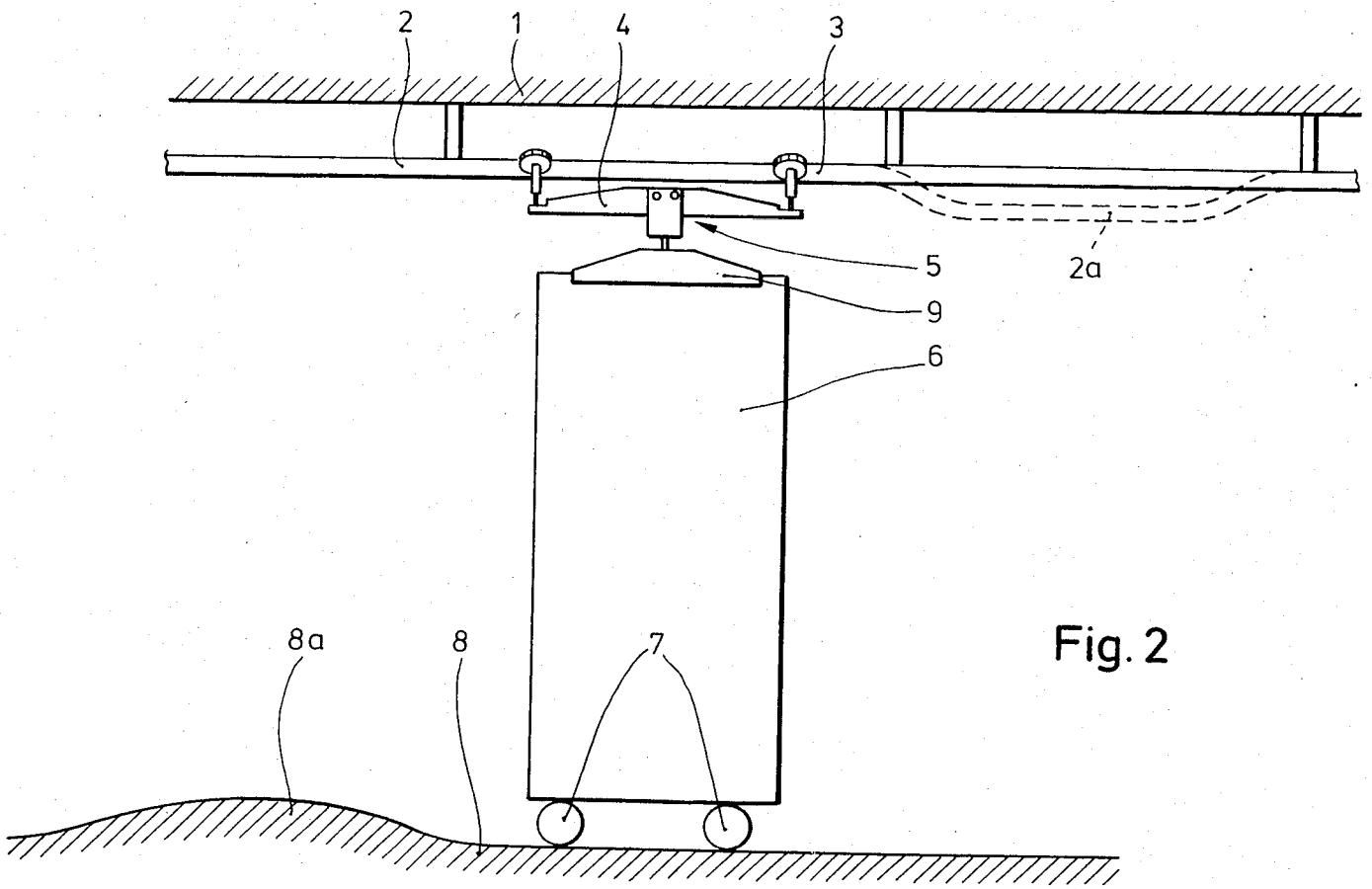

An exemplary embodiment of the invention shall now be described with reference to the accompanying drawings, wherein:

FIG. 1 shows a partially diagrammatical side view of a section of the conveyor apparatus according to the invention, with a container means in the act of being suspended from the conveyor apparatus, FIG. 2 shows a further section of the conveyor apparatus with a container means suspended therefrom, and FIG. 3 shows an enlarged, partially sectioned front view of certain parts of the conveyor apparatus.

The conveyor apparatus shown is intended for intra-plant suspension conveyance. It comprises a conveyor rail system 2 suspended from a ceiling 1 or a corresponding carrying structure. Suspended from rails 2 by means of brackets 3 for travel therealong are bridge-type carriers 4. Brackets 3 are attached to the longitudinal end portions of carriers 4.

Carrier 4 is adapted to have connected thereto a carrier head 5, itself connected to container means 6 for the goods to be conveyed. In FIG. 1, container means 6 is only schematically indicated. As shown in this figure, the connection is accomplished by pushing the carrier head over the carrier in the conveying direction, as will be explained in more detail hereunder.

FIG. 2 shows a largely diagrammatical view of another section of the conveyor rail system. The carrier 4 suspended therefrom is connected to a carrier head 5 and thus with container means 6 associated therewith. In the embodiment shown, container means 6 is designed as a container provided with ground-engageable rollers 7 at its bottom. Rollers 7 enable container 6 to travel over the ground 8 without being suspended from rails. The conveyor rail 2 shown in FIG. 2 comprises a rail section 2*a* extending at a lower level than the remainder of the rail system, while ground 8 is formed with a raised portion 8*a*. The function of these elements will also be explained hereinafter.

FIG. 3 shows an end view of the main parts of carrier 4 in connection with carrier head 5. Carrier 4 is of U-shaped channel configuration. As evident from FIGS. 1 and 3, brackets 3 are attached to the bottom wall of the U-section channel adjacent the longitudinal ends of carrier 4. From FIG. 1 it is further evident that the upper rims 4*a* of the legs of the channel section extend at a downwards inclined angle from the central portion of carrier 4 to the longitudinal ends thereof.

Carrier head 5 comprises a sheet metal connection bracket 9 directly attached to container means 6 as shown in FIGS. 1 and 2. Connection bracket 9, which in the embodiment shown may also be a channel section member, mounts a suspension rod 10 connected to a fork head 11. This connection may also formed by a rotatable bearing arrangement. As shown in FIG. 3, fork head 11 is of U-shaped channel configuration the interior width of which is greater than the width of the channel section forming carrier 4. The legs 11*a* of the U-shaped channel section have inwards and downwards bent end portions 11*b*, resulting in an inverted U-shape channel section. Mounted in spaced relationship between legs 11*a* and downwards bent end portions 11*b* thereof at each longitudinal side of carrier head 5 are two bolts 12. The longitudinally extending sides of carrier 4 have their central portions formed with upwards opening recesses 13, the longitudinal spacing of which corresponds to that of bolts 12. The dimensions of recesses 13 are selected such that each bolt 12 may be received in a correspinding recess 13 as in a bearing assembly. Adjacent each recess 13, rim portions 4*a* of carrier 4 are formed with a small step 14 at the side closer to the respective longitudinal end of the carrier.

Connection of the carrier 4 to carrier head 5, or its fork head 11, respectively, and separation of the two parts are accomplished in the following manner:

As shown in FIG. 1, carrier head 5 is advanced towards carrier 4 in the direction of arrow A and pushed thereonto in the longitudinal direction. To this effect, fork head 11 is raised, so as to enable bolts 12 to move freely over the upper rims 4*a* of carrier 4 to an aligned position above recesses 13. By lowering the fork head, bolts 12 are subsequently brought into engagement with recesses 13. Separation of the two parts is accomplished inversely by raising the fork head until bolts 12 are clear of recesses 13 and upper rims 4*a*, whereupon the carrier head may be withdrawn in the longitudinal direction. As shown in FIG. 3, each bracket 3 is of Y-shaped configuration with two arms 3*a* extending obliquely upwards from a point closely above the bottom wall of the channel-section carrier and carrying rollers 15 adjacent their upper ends for travel along rails 2. As, however, the upper rims 4*a* of carrier 4 are downwards inclined towards the longitudinal ends of the carrier, the fork head may at an early time be lowered to such a degree, that the inwards bent end portions of its legs are at a level whereat the arms 3*a* of bracket 3 are still relatively close to one another. In FIG. 3, the level of the upper rim 4*a* adjacent the carrier end is represented by a straight line, although it is in fact rounded at this location, as shown in FIG. 1.

The above described method for connecting the carrier and carrier head to each other, or for separating the two parts, respectively, is applicable to any type of container means suspended from the carrier head. An advantageously simple and practically automatically operating arrangement is shown in FIG. 2 wherein the container means is shown as a container provided with ground-engageable wheels or rollers 7. This construction allows the container to be conveyed over the ground 8 by travelling on its rollers, or to be conveyed in a suspended condition. FIG. 2 shows two different disengagement or release locations which may selectively be employed singly or in combination. Both release locations have in common that a relative vertical movement between carrier head 5 and carrier 4 is brought about in a positive manner. In the release location 2*a*, represented by a lowered rail section, the brackets, and thus the carrier, move to a lower level. This results in the container 6 being set down on ground 8, whereby fork head 11 is effectively raised to lift bolts 12 out of recesses 13. Subsequent displacement of either the container or the carrier with its brackets will then automatically result in separation of the two parts.

The raised portion 8*a* of ground 8 brings about a relatve movement in the opposite sense: as the carrier with the container suspended therefrom travels along the horizontal rail section 2 in the direction of raised ground portion 8*a*, the rollers of the container travel upwards so as to lift the container, and thus the carrier head, relative to the carrier.

The connection of a wheeled container to the carrier for suspension conveyance is accomplished at the same locations in a similarly simple manner.

The invention is not restricted to the embodiment shown and described. It is thus within the scope of the invention to vary the configuration of the carrier 4 as well as that of the carrier head 5 within a wide range, particularly as regards their cross-sectional shape. In the case of the carrier head 5, the fork head may be omitted and the connection bracket 9 itself be designed for direct engagement with the carrier 4. By way of exemplary profile sections it should merely pointed out that the carrier could have a T- or I-shaped cross-section, in which case the carrier head would be designed to straddle a flange of the section from below and might be provided with engaging elements adapted to be inserted from above into bores formed in the flange.

With the two recesses at each longitudinal side of the carrier and the two bolts at each side of the carrier head, the described embodiment acts as a pendulum suspension, offering the advantage that the two parts are readily connected to and separated from one another without the danger of jamming even if one of the two parts were tilted relative to the other. A pendulum-type suspension arrangement is also possible, however, with only a single bolt on each side. A rigid suspension preventing any pendulum-type movement might be achieved by the employ of more than two recesses and/or engaging elements of different cross-sectional shape or by means of other connection arrangements.

Within the scope of the invention, the connection between a container equipped with ground-engaging rollers 7 and the carrier head 5 may be accomplished by the use of a suspension rod of limited resiliency in place of a rigid suspension rod, for instance by the employ of a spring of limited elongation. If in this case at least one of the ground-engaging rollers is constructed as a castor roller, the carrier head connected to the rail in the manner described may act as a steering system for the container as the latter is conveyed over the ground.

We claim:

1. Conveyor apparatus, particularly for intraplant suspension conveyance, comprising a conveyor rail system for the conveyance therealong in a longitudinal direction of a bridge-type carrier suspended at both ends from said conveyor system by means of rollers connected to said carrier by brackets, and container means for the goods to be conveyed, said container means being suspended from said carrier by means of a carrier head releasably engaging said carrier from above, characterized in that said carrier head (5) is adapted to be released from said carrier (4) by being lifted relatively thereto and laterally withdrawn in the longitudinal direction relative to said carrier without interference with said brackets.

2. Apparatus according to claim 1, characterized in that said brackets (3) are attached to said carrier (4) within the limits of its cross-section and that said carrier head (5) is of a cross-sectional configuration at least partially surrounding the carrier profile in the lateral direction and engaging over rim portions (4*a*) thereof.

3. Apparatus according to claim 2, characterized in that the rim portions (4*a*) of said carrier (4) engaged by said carrier head (5) are formed with downwards inclined sections adjacent their longitudinal ends.

4. Apparatus according to claim 1, characterized in that the portions (11*a*) of said carrier head (5) engaging over the carrier rim portions (4*a*) are provided with engaging elements (12) and that said carrier rim portions (4*a*) are formed with recesses (13) for receiving said engaging elements (12).

5. Apparatus according to claim 4, characterized in that the spacing between said engaging elements is adjustable.

6. Apparatus according to claim 4, characterized in that said carrier head (5) is a channel section having the free end portions (11*b*) of its legs bent inwardly over themselves and provided with said engaging elements (12) attached thereto.

7. Apparatus according to claim 6, characterized in that at least one bolt (12) is mounted between each of said inwardly bent leg end portions (11*b*) and the associated leg (11*a*) of the channel section and that the upper rim portions (4*a*) of said carrier (4) are formed with upwardly opening recessed (13) for receiving said bolts (12) therein.

8. Apparatus according to claim 1 or 2 or 3 or 4 or 5 or 6 or 7, characterized in that said carrier (4) is substantially formed as an upwardly opening channel section, with said brackets (3) being affixed to the channel bottom.

9. Apparatus according to claim 1, characterized in that said carrier head (5) is connected to container means (6) in the form of a preferably wheeled ground-engageable container, and in that said conveyor rail system (2) is provided with release locations (2*a* and 8*a*, respectively) whereat a relative vertical movement between said carrier (4) and said carrier head (5) is positively brought about by the engagement of said container (6) with the ground (8).

10. Apparatus according to claim 9, characterized in that said release locations for said carrier head (5) are defined by portions (2*a*) of said conveyor rail system (2) extending at a lower level than the rest of the conveor system.

11. Apparatus according to claim 9, characterized in that said release locations are defined by raised portions (8*a*) of the ground (8) effective to lift said container (6) together with said carrier head (5) relative to said carrier (4).

12. Conveyor apparatus, particularly for intra-plant suspension conveyance, comprising a conveyor rail system for the conveyance therealong of a bridge-type carrier suspended at both ends from the conveyor rail system by means of rollers connected to said carrier by brackets, and container means for the goods to be conveyed, said container means being suspended from said carrier by means of a carrier head releasably engaging said carrier from above, said carrier head being adapted to be released from said carrier by being lifted relatively thereto and laterally withdrawn in the longitudinal direction thereof, said brackets being attached to said carrier within the limits of its cross-sectional configuration and said carrier head being of a cross-sectional configuration at least partially surrounding the carrier profile in the lateral direction and engaging over rim portions thereof, said rim portions of said carrier being engaged by said carrier head and being formed with downwardly inclined sections adjacent their longitudinal ends.

13. Apparatus according to claim 12, characterized in that the portions of said carrier head engaging over the carrier rim portions are provided with engaging elements and that carrier rim portions are formed with recesses for receiving said engaging elements.

14. Apparatus according to claim 13, characterized in that the spacing between said engaging elements is adjustable.

15. Apparatus according to claim 13, characterized in that said carrier head is a channel section having the free end portions of its legs bent inwardly over themselves and provided with said engaging elements attached thereto.

16. Apparatus according to claim 15, characterized in that at least one bolt is mounted between each of said inwardly bent leg end portions and the associated leg of the channel section and that the upper rim portions of said carrier are formed with upwardly opening recesses for receiving said bolts therein.

17. Apparatus according to claim 12 or 13 or 14 or 15 or 16, characterized in that said carrier is substantially formed as an upwardly opening channel section, with said brackets being affixed to the channel bottom.

18. Apparatus according to claim 12, characterized in that said carrier head is connected to container means in the form of a preferably wheeled ground-engageable container, and in that said conveyor rail system is provided with release locations whereat a relative vertical movement between said carrier and said carrier head is positively brought about by the engagement of said container with the ground.

19. Apparatus according to claim 18 characterized in that said release locations for said carrier head are defined by portions of said conveyor rail system extending at a lower level than the rest of the conveyor system.

20. Apparatus according to claim 18, characterized in that said release locations are defined by raised portions of the ground effective to lift said container together with said carrier head relative to said carrier.

* * * * *